United States Patent [19]

Merkel

[11] 4,082,555

[45] Apr. 4, 1978

[54] PHOTOTHERMOGRAPHIC MATERIALS AND PROCESS

[75] Inventor: Paul Barrett Merkel, Rochester, N.Y.

[73] Assignee: Eastman Kodak Company, Rochester, N.Y.

[21] Appl. No.: 715,366

[22] Filed: Aug. 18, 1976

[51] Int. Cl.[2] ..... G03C 1/02; G03C 5/24; G03C 1/76; G03C 1/00

[52] U.S. Cl. ..... 96/114.1; 96/48 HD; 96/67; 427/385 B; 96/95; 96/63

[58] Field of Search ..... 96/114.1, 67, 48 HD, 96/63, 95; 427/385 B

[56] References Cited

U.S. PATENT DOCUMENTS

| | | | |
|---|---|---|---|
| 3,024,362 | 3/1962 | Sus et al. | 427/385 B |
| 3,152,903 | 10/1964 | Shepard et al. | 96/114.1 |
| 3,152,904 | 10/1964 | Sorenson et al. | 96/114.1 |
| 3,220,846 | 11/1965 | Tinker et al. | 96/114.1 |
| 3,301,678 | 1/1967 | Humphlett et al. | 96/67 |
| 3,531,285 | 9/1970 | Haist et al. | 96/67 |
| 3,877,940 | 4/1975 | Ericson | 96/114.1 |
| 3,893,859 | 7/1975 | Burness et al. | 96/114.1 |

*Primary Examiner*—Edward C. Kimlin
*Assistant Examiner*—Louis Falasco
*Attorney, Agent, or Firm*—Richard E. Knapp

[57] ABSTRACT

A covering power imaging heat developable and heat stabilizable photographic material comprising in reactive assocation (a) photographic silver salt, (b) a photographic silver salt developing agent, (c) an activating concentration of a certain development activator precursor and (d) a polymeric binder, enables an image to develop and be stabilized even though the photothermographic material contains no separate post-processing image stabilizer, and also enables silver image development efficiency of at least 90% when the material is heated to a temperature within the range of about 120° to 200° C. An image can be developed in this heat developable and heat stabilizable photographic material by merely heating the material after imagewise exposure to moderately elevated temperatures. Other addenda employed in heat developable materials can be employed in the described heat developable photographic materials.

24 Claims, No Drawings

PHOTOTHERMOGRAPHIC MATERIALS AND PROCESS

BACKGROUND OF THE INVENTION

1. Field of the Invention

This invention relates to heat developable and heat stabilizable materials and processes for developing an image employing the described materials. In one of its aspects it relates to a heat developable and heat stabilizable photographic element comprising the described combination of components. In another aspect it relates to a heat developable and heat stabilizable photographic composition comprising the described imaging combination. A further aspect of the invention relates to a process of developing and stabilizing an image in a heat developable photographic material containing the described imaging combination.

2. Description of the State of the Art

It is known to obtain an image in an imaging material, especially a photographic imaging material, by what is known as dry processing with heat. These materials are sometimes described as heat developable photographic materials or photothermographic materials. Such heat developable photographic materials are imagewise exposed to provide a latent image. They are then heated to provide a developed image in the absence of separate processing solutions or baths. Typical heat developable imaging materials or photothermographic materials are described, for example, in U.S. Pat. No. 3,152,904 of Sorenson et al, issued Oct. 13, 1964; U.S. Pat. No. 3,457,075 of Morgan et al, issued July 22, 1969; U.S. Pat. No. 3,152,903 of Shepard et al, issued Oct. 13, 1964; U.S. Pat. No. 3,392,020 of Yutzy et al, issued July 9, 1968; and British Specification No. 1,161,777 published Aug. 20, 1969.

Most heat developable photographic materials or photothermographic materials comprising photosensitive silver compounds have required a separate post-processing image stabilizer or stabilizer precursor to enable a stable image after processing. Typically, the post-processing stabilizer or stabilizer precursor has been incorporated in the photothermographic material and is a sulfur-containing compound. Upon heating the image stabilizer or stabilizer precursor forms a stable silver mercaptide or silver complex with the silver compounds in the non-image areas of the photographic material. This provides post-processing image stabilization. Sulfur-containing stabilizers or stabilizer precursors of this class are described, for example, in U.S. Pat. No. 3,301,678 of Humphlett et al, issued Jan. 31, 1967; U.S. Pat. No. 3,506,444 of Haist et al, issued Apr. 14, 1970; and U.S. Pat. No. 3,669,670 of Haist et al, issued June 13, 1972. Typical sulfur-containing image stabilizer precursors are isothiouronium compounds which provide stabilization of a developed image upon heating of the material containing the described stabilizer precursors. It has been advantageous to provide a material which enables a stabilized image in the absence of these image stabilizers or stabilizer precursors or other compounds designed as post-processing stabilizers. However, none of the above patents suggest a solution to this problem.

It has also been typical to incorporate what is known as an activator or activator precursor in a heat developable and heat stabilizable photographic material. Such activators or activator precursors upon heating provide activation of the imaging process. Usually these compounds enable activation of the developing agent or developing agent precursor to provide development of the latent image in the heat developable material. These activators or activator stabilizers are typically alkali-release or base-release compounds which provide the desired increase in pH in the photographic material upon heating of the activator or activator precursor. Examples of activators or activator precursors in heat developable photographic materials or photothermographic materials are described, for instance, in U.S. Pat. No. 3,531,285 of Haist et al, issued Sept. 29, 1970. An example of an activator precursor which has been used in a heat developable material is guanidinium trichloroacetate which provides an increase in pH in the described heat developable photographic material. It has been desirable in these heat developable photographic materials to provide an increased development efficiency of the latent image. Typically the development efficiency of the latent image is far less than 90% and typically within the range of about 30 to 50% development efficiency. Accordingly, a significant concentration of the photographic silver salt remains unused in the development process. The mass of silver developed in these heat developable materials has been dependent upon the degree of imagewise exposure provided. It has been desirable to provide a material which is less dependent upon exposure and more dependent upon the development process to provide the desired development efficiency. The described activator precursors have not provided the desired increased development efficiency or enabled post-processing image stabilization in the absence of a separate image stabilizer or stabilizer precursor.

Further, it has been desirable to provide heat developable photographic materials which enable the stabilization of a processed image and provide development efficiency greater than 90% and still enable the use of conventional silver salt developing agents, especially silver halide developing agents, known to be useful in heat developable photographic materials. Many heat developable photographic materials used commercially employ unconventional reducing agents which require costly processes of preparation. It has been desirable to eliminate this problem with a heat developable photographic material which provides the described advantages and also enables use of conventional developing agents or developing agent precursors which can be incorporated in photographic materials without adversely affecting the desired properties of the photographic material. Commercially available photothermographic materials have used such a reducing agent as 2,2'-methylene bis(4-methyl-6-tertiary butylphenol) which is not a conventional, easily prepared silver halide developing agent. This reducing agent also does not provide the desired development efficiency nor does it enable stabilization of an image in the absence of a separate post-processing image stabilizer.

It has been desirable to provide a heat developable photographic material which enables the use of a reduced concentration of silver in the imaging process and material. The heat developable materials described have not enabled the desired degree of reduction of silver in a heat developable material.

One of the advantages of a photographic material which is heat developable and employs no separate post-processing image stabilizer or stabilizer precursor is that improved processing temperature latitude can be provided due to the fact that no stabilization reaction is required to compete with the image development reaction. Also, light stability of a processed material in the absence of a separate stabilizer can be superior to that of heat developable materials comprising a sulfur-containing stabilizer because no silver mercaptide is formed which can photolytically form silver sulfide over an extended time. Also, in the absence of the silver mercaptide, better light absorption characteristics can be observed to provide improvement in image contrast when observed with near ultraviolet radiation. This is advantageous in the graphic arts area involving reproduction of materials which are sensitive to ultraviolet radiation.

Another property which has been desirable in heat developable materials as described has been the property of non-volatility of the activators or activator precursors which are useful in heat developable materials. Unfortunately, heat developable photographic materials or photothermographic materials containing such an activator or activator precursor as guanidinium trichloroacetate do not provide this advantage.

Photographic materials which provide for development of a latent image by conventional processing solutions or baths are well known. It is also known to provide development of an image in such materials by what is known as covering power imaging. A fundamental difference exists between conventional silver development processes and what are known as covering power imaging processes. In most conventional photographic silver materials, changes in optical density with exposure arise primarily from differences in the amount of silver reduced at the latent image sites. In silver covering power imaging the amount of silver reduced does not vary greatly with exposure. In such covering power imaging, density variations at image areas are due, for the most part, to differences in silver covering power at various exposure levels. Silver covering power imaging as used herein is intended to mean imaging in a photographic material in which variations in optical density of the developed image derive primarily from variations in silver covering power as a function of exposure. Covering power as used herein is intended to mean the measure of the silver opacity in the developed image and is derived arithmetically by dividing (a) the optical density by (b) the grams of developed silver per square decimeter in the layer of the material containing the developed image. Covering power and covering power imaging are known in conventional photographic materials which provide development with processing solutions or baths. This is described, for example, in the article by K. Murofushi, *J. Soc. Sci. Phot.*, Japan, Volume 30 (4), 193–198 (1967), Canadian Pat. No. 808,585 and "The Theory of the Photographic Process," 3rd Ed., by Mees, 1966, pages 74–75 and 419–420. None of the photographic materials described have used covering power imaging in heat developable and heat stabilizable materials.

It has been desirable to provide a heat developable and heat stabilizable photographic material which provides development efficiency of an image of at least 90% and enables a developed and stabilized image to be provided in the absence of a separate post-processing image stabilizer or stabilizer precursor.

SUMMARY OF THE INVENTION

It has been found according to the invention that the described advantages can be provided in a covering power imaging, heat developable and heat stabilizable photographic material comprising in reactive association (a) photographic silver salt, especially photographic silver halide, (b) a photographic silver salt developing agent, especially a photographic silver halide developing agent, (c) an activating concentration of a development activator precursor represented by the formula:

$$A^{\oplus} \cdot B^{\ominus}$$

wherein $A^{\oplus}$ is a protonated primary, secondary or tertiary amine having a pKa within the range of about 8 to 12; and $B^{\ominus}$ is a carboxylate ion, as described herein, wherein the activator precursor releases a non-volatile amine moiety at a temperature within the range of 120° to 200° C, (d) a polymeric binder, and wherein the heat developable and heat stabilizable photographic element (1) contains no separate post-processing image stabilizer and (2) provides silver image development efficiency of at least 90% when heated to a temperature within the range of 120° to 200° C. Development and stabilization of an image in the described heat developable and heat stabilizable materials can be provided by merely heating the material at moderately elevated temperatures until the desired image is developed, such as for several seconds, at a temperature within the range of about 120° to about 180° C. No processing solutions or baths are required to provide a developed image having the described properties. Also, none of the described development activator precursors have been used in the past in processing baths or solutions for covering power imaging as described.

DETAILED DESCRIPTION OF THE INVENTION

An important embodiment of the invention is a covering power imaging, heat developable and heat stabilizable photographic element comprising a support having thereon in reactive association the described components (*a*), (*b*), (*c*), and (*d*). An especially useful embodiment is one containing the described components in which the photographic silver salt is photographic silver halide and the photographic silver salt developing agent is a 3-pyrazolidone silver halide developing agent, including combinations of such a developing agent with other suitable developing agents.

The term "covering power imaging" as employed herein is intended to refer to a photographic silver salt material in which the imaging mechanism is one in which the required mass of silver developed is essentially independent of exposure. It is also intended to include those materials in which covering power variations responsible for imaging arise from silver particle size differences in the exposed and unexposed areas primarily. The particles developed in the unexposed areas of the photographic material with covering power imaging are formed by what is believed to be solution physical development on fog centers, and typically have particle diameters ten times as large and contain about 1,000 times as much silver as the silver particles in the exposed and maximum density areas of the developed photographic material. In the resulting image areas, a roughly ten-fold difference in transmission density between maximum density and minimum density can be expected. In view of the fact that development is essentially complete throughout the element, that is a development efficiency of at least 90% occurs, no need is present for fixation or stabilization of undeveloped silver ions. The excellent photolytic stability of the photographic materials upon development is a direct consequence of the fact that no photosensitive or other silver salts or complexes remain in any part of the element to print-up after processing. Total development to a degree of at least 90% in the exposed and unexposed areas of the element also provides insurance against undesired fog formation from over processing and results in desired processing temperature latitude.

The term "protonated primary, secondary or tertiary amine" is intended to mean a moiety that provides the desired activation of the silver salt developing agent as described and enables the desired covering power imaging. The term "protonated" is intended to mean an amine moiety to which one or more hydrogen ions ($H^+$) is attached forming a positively charged ion.

An especially useful covering power imaging, heat developable and heat stabilizable element according to the invention comprises a support having thereon in reactive association described components (*a*), (*b*), (*c*), and (*d*) and wherein the development activator precursor is one in which $A^{\oplus}$ is represented by the formula:

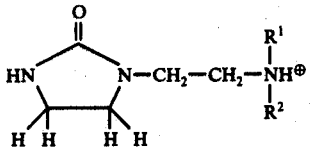

wherein $R^1$ and $R^2$ are independently selected from the group consisting of hydrogen and alkyl containing 1 to 10 carbon atoms such as methyl, propyl, pentyl and the like. Alkyl as employed herein is intended to include alkyl containing substituent groups which do not adversely affect the desired properties of the heat developable and heat stabilizable photographic materials of the invention. A suitable substituent group which does not adversely affect the desired properties is hydroxyl.

Another especially useful photothermographic element as described is one in which the carboxylate ion moiety $B^{\ominus}$ in the activator precursor is an alpha-sulfonylacetic acid. An especially useful alpha-sulfonylacetic acid is one represented by the formula:

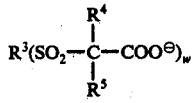

wherein *w* is 1 or 2; $R^3$ is alkyl containing 1 to 10 carbon atoms, such as methyl, ethyl, propyl, and butyl; aryl containing 5 to 10 carbon atoms, such as phenyl and pyridyl; or carboxymethyl when *w* is 1 and alkylene containing 1 to 6 carbon atoms, such as ethylene or arylene containing 6 to 8 carbon atoms, such as phenylene and phenylethylene when *w* is 2; $R^4$ and $R^5$ can be the same or different and individually represent hydrogen, alkyl containing 1 to 6 carbon atoms, such as methyl, ethyl, propyl and hexyl, or aryl containing 5 to 10 carbon atoms, such as phenyl and pyridyl. Aryl, alkylene, arylene and alkyl as employed herein are intended to include the described groups which are unsubstituted or contain substituent groups which do not adversely affect the desired properties of the described heat developable and heat stabilizable photographic materials of the invention. Examples of suitable groups which can be used as substituents include hydroxyl, carboxamido, carbamoyl and alkylsulfonyl.

Examples of useful protonated primary amines as described are:

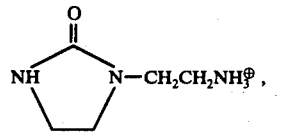

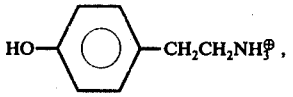

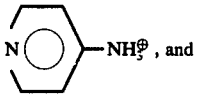

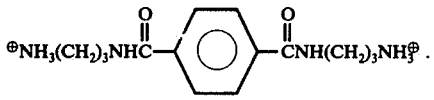

Examples of useful protonated secondary amines as described are:

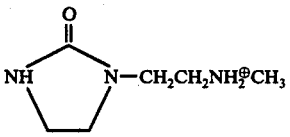

Examples of useful protonated tertiary amines as described are:

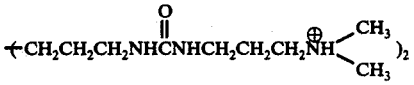

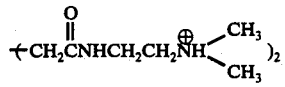

An especially useful activator precursor, as described, is 1-(β-aminoethyl)-2-imidazolidone trichloroacetate.

The concentration of the described activator precursor in the heat developable and heat stabilizable materials of the invention is important. The concentration must be an activating concentration, that is, it must be sufficient to provide the desired activation and to provide the solution physical development on the latent image and fog centers to provide the desired degree of development efficiency. The optimum concentration useful for the described invention will depend upon such factors as the particular heat developable and heat stabilizable photographic material, desired image, processing conditions, particular activator precursor, other components in the material and the like. A typically useful concentration of activator precursor is within the range of 0.4 to 3.0 moles of the described development activator precursor per mole of silver in the heat developable and heat stabilizable photographic material. When the described 1-(β-aminoethyl)-2-imidazolidone compound is employed as the activator precursor, the activating concentration is typically within the range of about 1.0 to 2.0 moles of the activator precursor per mole of silver in the element.

Combinations of the described activator precursors are also useful. The optimum combination of activator precursors can be determined based on such factors as the particular heat developable and heat stabilizable photographic material, desired image, processing conditions, other components in the photographic material, and the like. An example of a combination of activator precursors is the combination of 1-(β-aminoethyl)-2-imidazolidone trichloroacetate with 4-aminopyridine trichloroacetate.

Preparation of the described activator precursors can be carried out using procedures known in the art. For example, the described 1-(β-aminoethyl)-2-imidazolidone trichloroacetate can be prepared by dissolving the acid and base components of the compound in a solvent, such as methanol and ethanol, mixing the components, and then adding a sufficient quantity of a less polar solvent, such as ether, to provide full precipitation of the carboxylate salt. Another example is the preparation of the trichloroacetate salt of 4-aminopyridine. In this preparation a solution of 10 grams of trichloroacetic acid in 40 milliliters of ethanol is mixed with 5 grams of 4-aminopyridine in 60 milliliters of ethanol. The desired salt precipitates on addition of 100 milliliters of diethylether to the resulting composition. The desired salt can be purified, such as by filtration and washing with an additional 50 milliliters of ether.

The described heat developable and heat stabilizable materials according to the invention are typically aqueous formulations, such as aqueous gelatino photographic emulsions. However, the materials can be nonaqueous and contain hydrophobic materials, such as ethyl cellulose and poly(vinyl butyral).

The covering powering imaging, heat developable and heat stabilizable photographic materials of the invention contain a photographic silver salt. The term "photographic silver salt" as employed herein is intended to include silver materials which can be either salts, complexes or other forms which are sensitive to radiation to provide a developable latent image. Especially useful silver salts are photographic silver halides due to their high degree of photosensitivity. The term "photographic" is intended to include photosensitive materials. A typical concentration of photographic silver salt in the described materials is within the range of about 0.02 to about 0.3 millimoles of the photographic silver salt per $dm^2$ of support in the photographic material. For example, a typically preferred concentration range of photographic silver halide is within the range of about 0.05 to about 0.15 moles of photographic silver halide per $dm^2$ of support in the described photographic materials of the invention. Other photographic materials can be used in combination with the described photographic silver salt if desired. It is necessary, however, that the other photographic materials not adversely affect the desired described properties of the covering power imaging materials of the invention. For example, useful photosensitive silver salts which can be used as the described photographic silver salt include silver dye complexes such as described in U.S. Pat. No. 3,647,439 of Bass, issued Mar. 7, 1972. Especially useful photographic silver halides are silver chloride, silver bromide, silver bromoiodide, silver chlorobromoiodide or mixtures thereof. For purposes of the invention, silver iodide is also considered to be a useful photographic silver halide. Fine-grain photographic silver halides are especially useful although coarse or fine-grain photographic silver halide can be employed if desired. The photographic silver halide can be prepared by any of the procedures known in the photographic art, especially those procedures which involve the preparation of photographic silver halide gelatino emulsions. Useful procedures and forms of photographic silver halide for purposes of the invention are described, for example, in the *Product Licensing Index,* Volume 92, December 1971, publication 9232 on page 107. The photographic silver halide, as described, can be washed or unwashed, can be chemically sensitized using chemical sensitizing procedures known in the art, can be protected against production of fog and stabilized against the loss of sensitivity during keeping as described in the above *Product Licensing Index* publication.

The described heat developable and heat stabilizable photographic materials can comprise a variety of photographic silver salt developing agents, especially organic silver salt developing agents that are typically photographic silver halide developing agents. Combinations of photographic silver salt developing agents, typically combinations of silver halide developing agents, can be useful in the described materials of the invention. Developing agents which are especially useful are silver halide developing agents including polyhydroxybenzenes, such as hydroquinone, alkyl-substituted hydroquinone, including tertiary butylhydroquinone, methylhydroquinone, 2,5-dimethylhydroquinone, and 2,6-dimethylhydroquinone; catechol and pyrogallol developing agents; chloro-substituted hydroquinones such as chlorohydroquinone or dichlorohydroquinone; alkoxy-substituted hydroquinone, such as methoxyhydroquinone or ethoxyhydroquinone; aminophenol reducing agents, such as 2,4-diaminophenols and methylaminophenols; ascorbic acid developing agents, such as ascorbic acid, ascorbic acid ketals and other derivatives of ascorbic acid; hydroxylamine reducing agents, such as N,N-bis[2-(4′-pyridyl)-ethyl]-hydroxylamine; 3-pyrazolidone developing agents such as 1-phenyl-3-pyrazolidone and 4-methyl-4-hydroxymethyl-1-phenyl-3-pyrazolidone; reductone developing agents, such as 2-hydroxy-5-methyl-3-piperidino-2-cyclopentanone; gallic acid ester developing agents, such as methylgallate; phenylenediamine developing agents such as paraphenylenediamine and the like. Especially useful developing agents are 3-pyrazolidone silver halide developing agents as described.

A useful concentration of developing agent in a heat developable and heat stabilizable photographic material, as described, is typically within the range of about 0.25 mole to about 2.0 moles of developing agent per mole of silver salt in the described material. An especially useful concentration of developing agent is within the range of about 0.5 to about 1.0 moles of developing agents per mole of silver salt in the described material. When a combination of developing agents is used, the total concentration of the combination is within the described concentration ranges. The optimum concentration of developing agent can be determined based upon such factors as the particular components in the heat developable material, desired image, processing conditions and the like.

The heat developable photographic materials as described can contain a variety of colloids and polymers, alone or in combination, as vehicles, binding agents and in various layers. Useful materials as described are preferably hydrophilic materials although some hydrophobic materials can be useful. The colloids and polymers are transparent or translucent and include both naturally-occurring substances, such as proteins, for example, gelatin, gelatin derivatives, cellulose derivatives, polysaccharides, such as dextran and the like; and synthetic polymeric substances such as water soluble polyvinyl compounds like poly(vinyl pyrrolidone), acrylamide polymers and the like. Other synthetic polymeric compounds which can be useful include dispersed vinyl compounds such as in latex form and particularly those that increase dimensional stability of photographic materials. Effective polymers which are useful as binders include high molecular weight materials, especially polymers and resins which are compatible with the described components of the heat developable photographic material of the invention. Especially useful polymeric binders include gelatin, poly(vinyl pyrrolidone), and poly(vinyl alcohol). Other useful polymeric binders include copolymers of acrylamide with 1-vinylimidazole and copolymers of acrylamide with 2-acetoacetoxyethylmethacrylate. Combinations of the described colloids and polymers can also be useful as the polymeric binder.

The heat developable and heat stabilizable photographic materials according to the invention can contain an image toner, especially a thionamide image toner, in order to provide a more neutral or black tone image upon processing. The optimum toning agent will depend upon such factors as the particular heat developable photographic material, the desired image, particular processing conditions and the like. In some cases certain image toning agents provide better results with certain activator precursors and photographic silver salts. A simple screening test can be used to select an optimum image toning agent. One such test is described in following Example 2. In this test the most useful toning agent is typically that toning agent which provides a ratio of (a) visible maximum density to (b) blue light maximum density exceeding a value of about 0.8. Useful toning agents include, for instance, 3-amino-4-phenyl-1,2,4-triazolidene-5-thione and 3-mercapto triazole. Combinations of toning agents can be useful if desired.

A range of concentration of toning agent is useful in a heat developable photographic material as described. A typically useful concentration of toning agent is within the range of about 0.005 to 0.10 moles of toning agent per mole of photographic silver salt in the heat developable photographic material of the invention. The optimum concentration of toning agent will depend upon such factors as the particular heat developable photographic material, processing conditions, desired image and the like.

It can be useful in certain instances to provide a development restrainer or development modifier in the described photographic material to provide the desired degree of development. Development modifiers or development restrainers as used herein are intended to mean compounds which restrict the number of development sites in unexposed areas thereby producing low apparent fog in processed fresh or incubated materials according to the invention. Examples of useful development restrainers or modifiers include 1-methyl-3-[2-(methylcarbamoylthio)ethyl]urea and sodium bromide. Combinations of development restrainers or development modifiers can also be used if desired.

A range of concentration of development modifier or development restrainer can be useful in the described heat developable photographic materials. A typically useful concentration of development modifier or development restrainer is within the range of about 0.01 to about 0.2 moles of development modifier or development restrainer per mole of silver in the described heat developable photographic material. The optimum concentration of development modifier and development restrainer will depend upon such factors as described hereinabove.

It can be useful to include a melt-forming compound in the heat developable photographic materials according to the invention to provide an improved developed image. The term "melt-forming compound" as employed herein is intended to mean a compound which upon heating to the desired processing temperature provides an improved reaction medium, typically a molten medium, within which the described image-forming combination can provide better image development. The exact nature of the reaction mixture at processing temperatures described is not fully understood; however, it is believed that at the reaction temperatures a melt occurs which permits the reaction components to better interact. Useful melt-forming compounds are typically separate components from the image-forming materials, although the image-forming combination can enter into the melt formation. Typically useful melt-forming compounds are sorbitol, raffinose and N,N'-di(-methylcarbamoyl)-2-(2-aminoethyl)amino ethanol that are compatible with other components of the heat developable photographic material and do not adversely affect the desired properties of the photographic material, especially the desired sensitometric properties. Combinations of melt-forming compounds can be useful if desired.

A range of concentration of melt-forming compound can be useful in the heat developable photographic materials described. A typically useful concentration range of melt-forming compound is about 0.2 to about 2.0 moles of melt-forming compound per mole of silver in the photographic material. The optimum concentration of the melt-forming compound will depend upon the particular heat developable material, desired image, processing conditions an the like.

Spectral sensitizing dyes can be useful in the described materials of the invention to confer additional sensitivity to the materials. Useful sensitizing dyes are described, for example, in the *Product Licensing Index,* Volume 92, December 1971, Publication 9232, pages 107–110, paragraph XV. An advantage of the heat developable photographic materials according to the invention is that a wide range of spectral sensitizing dyes is useful due to the fact that the photographic materials enable use of silver halide gelatino emulsions. Combinations of sensitizing dyes can be useful in the materials of the invention.

The optimum concentration of the components of a heat developable photographic material according to the invention will depend upon a variety of factors as described. An especially useful heat developable photographic material according to the invention comprises for each mole of photographic silver salt, especially photographic silver halide, 0.5 to 1.0 moles of the described developing agent and 0.6 to 2.0 moles of the described development activator precursor.

"pKa" as employed herein is intended to mean the negative log (base 10) of the equilibrium constant between the protonated amine ($BH^+$) and the basic form (B), that is $$BH^+ \underset{}{\overset{Ka}{\rightleftharpoons}} B + H^+, \; Ka = \frac{\{B\}\{H^+\}}{\{BH^+\}}$$

It is possible in some cases to use a development activator precursor, as described, providing a pKa in the materials of the invention above 12 if a buffer component is added to the material to provide a desired balance of reactants. The pKa of the described materials can be determined by methods known in the photographic art. A typical method of determining pKa which is useful for materials, as described, is published in "The Determination of Ionization Constants", by A. Albert and E. P. Serjeant.

The range of melt pAg of the heat developable photographic materials can be wide. The pAg can be measured using conventional calomel and silver-silver chloride electrodes, connected to a commercially available digital pH meter. The typical melt pAg in a heat developable photographic material according to the invention is within the range of about 6 to about 12 with a preferred range of pAg being 8 to 10. The optimum pAg will depend upon the described factors, such as the particular heat developable photographic material, desired image, processing conditions and the like.

The heat developable photographic materials according to the invention typically have a melt pH range which is about 2 to about 7. A typically useful melt pH for a heat developable photographic material according to the invention is within the range of about 4 to about 5.

During development or processing of the exposed photographic material the pH range increases to a degree that provides desired development.

It is in some cases useful to have an overcoat or protective layer on the heat developable photographic element according to the invention to provide resistance to abrasion marks and other undesired marks. The overcoat or protective layer can be one or more of the described polymers which are also useful as binders. However, other polymeric materials which are compatible with the heat developable layer can be useful, especially those which can tolerate the processing temperatures employed according to the invention. Such other binders or polymeric materials include, for instance, ethyl cellulose and poly(methylmethacrylate). Combinations of polymeric materials can be useful for overcoat purposes if desired.

The heat developable materials according to the invention can contain other addenda such as compounds which function as speed-increasing compounds, hardeners, plasticizers and lubricants, coating aids, brighteners, absorbing and filter dyes, antistatic materials or layers, and the like. These are described, for example, in the *Product Licensing Index,* Volume 92, December 1971, Publication 9232, pages 107–110.

The heat developable elements according to the invention can comprise a variety of supports which can tolerate the processing temperatures employed according to the invention. Typical supports include cellulose ester film, poly(vinyl acetal) film, poly(ethylene terephthalate) film, polycarbonate film and polyester film supports as described in U.S. Pat. No. 3,634,089 of Hamb, issued July 11, 1972 and U.S. Pat. No. 3,725,070 of Hamb et al, issued Apr. 3, 1973. Related film and resinous support materials as well as glass, paper, metal and the like supports which can withstand the processing temperatures described are also useful. Typically a flexible support is most useful.

The compositions according to the invention can be coated on a suitable support by various coating procedures known in the photographic art including dip coating, air-knife coating, curtain coating or extrusion coating using hoppers, such as described in U.S. Pat. No. 2,681,294 of Beguin, issued June 15, 1954. If desired, two or more layers can be coated simultaneously such as described in U.S. Pat. No. 2,761,791 of Russell, issued Sept. 4, 1956 and British Pat. No. 837,095 published June 9, 1960.

The described components of the heat developable materials according to the invention can be in any suitable location in the heat developable element which provides the desired image. For example, if desired, one or more components of the heat developable element according to the invention can be in one or more layers of the element. In some cases it can be desirable to include certain percentages of the described developing agents and/or other addenda in a protective layer over the heat developable element. In some cases this can reduce migration of certain addenda between layers of the described element.

It is necessary that the photographic silver salt, especially photographic silver halide, as described, and other components of the photographic materials of the invention be in reactive association with each other in order to provide the desired image. The term "in reactive association" as employed herein is intended to mean that the photographic silver salt, especially the photographic silver halide, and the activator precursor and developing agent, as described, are in a location with respect to each other which enables the desired processing and provides a more useful developed image. It is possible, for example, to have a portion of the photographic silver salt in one layer and other components of the described photographic material in other layers. However, it is necessary that the components be in a location as described which enables the described covering power imaging.

If desired, other heat developable photographic materials can be used in combination with the heat developable photographic materials according to the invention. The other heat developable photographic materials must be compatible with and not adversely affect the image formation in a heat developable material according to the invention. For example, a heat developable photographic element can comprise respectively a support having thereon a heat developable photographic layer comprising (a) a complex of silver with a nitrogen acid compound, such as a silver complex described in copending U.S. application Ser. No. 684,699 of deMauriac, filed May 10, 1976, (b) a developing agent with (c) photographic silver halide in a separate layer with a covering power imaging heat developable and heat stabilizable material. It is necessary, however, that the other photographic materials not adversely affect the desired covering power imaging advantages of the invention.

An especially useful embodiment of the invention is a covering power imaging heat developable and heat stabilizable photographic element comprising a support having thereon in reactive association (a) a photographic silver halide gelatino emulsion, (b) a photographic silver halide developing agent, such as a 3-pyrazolidone silver halide developing agent, (c) and activating concentration of a development activator precursor consisting essentially of 1-(β-aminoethyl)-2-imidazolidone trichloroacetate, (d) a polymeric binder, such as a gelatino binder, and wherein the photographic element (1) contains no separate post-processing image stabilizer or stabilizer precursor, and (2) provides silver image development efficiency of at least 90% when heated to a temperature within the range of 120° to 200° C. This photographic element can contain, for example, 1-methyl-3-[2-(methylcarbamoylthio)ethyl]urea as development restrainer and 3-imino-4-phenyl-1,2,4-triazolidine-5-thione as an image toning agent.

Various imagewise exposure means are useful with the heat developable materials according to the invention. The materials according to the invention are typically sensitive to the ultraviolet and blue regions of the spectrum when they contain no sensitizing dye and exposure means which provide this radiation are preferred. Typically, however, if a spectral sensitizing dye is employed in the heat developable materials, exposure means using other ranges of the spectrum are useful. Typically, a photosensitive element according to the invention is exposed imagewise with a visible light source such as a tungsten lamp, although other sources of radiation are useful such as lasers, electron beams and the like.

A visible image can be developed in an exposed heat developable material, as described, within a short time merely by heating the heat developable material to moderately elevated temperatures. For example, an image can be developed in the described heat developable material by heating the element to a temperature within the range of about 120° to about 200° C. Heating is carried out until a desired image is developed, typically within about 1 to about 90 seconds, such as within about 1 to about 30 seconds. The heat developable material according to the invention is preferably heated to a temperature within the range of about 140° to about 170° C, typically for about 1 to about 30 seconds.

An advantage of the invention is that the process also stabilizes the image in a covering power imaging, heat developable and heat stabilizable photographic element as described.

The heat developable materials according to the invention are useful for forming a negative or positive image. The formation of a negative or positive image will depend primarily upon the selection of the photographic silver salt, especially the photographic silver halide. One class of useful photosensitive silver halide materials is the class of direct positive photographic silver halide materials designed to produce positive images. Internal image silver halide emulsions can be used for this purpose such as those described in U.S. Pat. No. 2,592,250 of Davey et al, issued Apr. 8, 1952; U.S. Pat. No. 3,206,313 of Porter et al, issued Sept. 14, 1965; U.S. Pat. No. 3,367,778 of Berriman et al, issued Feb. 6, 1968; and U.S. Pat. No. 3,447,927 of Bacon et al, issued June 3, 1969. If desired, mixtures of surface and internal image silver halide emulsions can be used as described in U.S. Pat. No. 2,996,382 of Luckey et al, issued Apr. 14, 1961.

Processing according to the invention is usually carried out under ambient conditions of pressure and humidity. Pressures and humidity outside normal atmospheric conditions can be used if desired. However, normal atmospheric conditions are preferred.

A variety of means can be employed to provide the necessary heating of the described heat developable materials to provide a developed image. The heating means can be a simple hot plate, iron, roller or the like.

The following examples are included for a further understanding of the invention.

EXAMPLE 1

Use of 1-(β-Aminoethyl)-2-Imidazolidone Trichloroacetate in a Covering Power Imaging, Heat Developable and Stabilizable Photographic Element A covering power imaging heat stabilizable photographic element was prepared by mixing and coating at a 4 mil wet coating thickness on a poly(ethylene terephthalate) film support the following:

| | | |
|---|---|---|
| photographic gelatin | 20 | mg/dm$^2$ |
| surfactant (Surfactant 10G, a nonylphenoxypolyglycidol available from Olin Corporation, U.S.A.) | 0.8 | mg/dm$^2$ |
| 1-(β-aminoethyl)-2-imidazolidone trichloroacetate | 50 | mg/dm$^2$ |
| 4-hydroxymethyl-4-methyl-1-phenyl-3-pyrazolidone | 10 | mg/dm$^2$ |
| sodium bromide | 0.15 | mg/dm$^2$ |
| silver bromoiodide gelatino emulsion (unsensitized, 0.1 micron particle size, 2.5 mole % iodide) | 10 | mg Ag/dm$^2$ |

The composition was mixed prior to coating with a solvent consisting of water containing about 5% by volume methanol. The resulting layer was permitted to dry at 43° C. A sample of the resulting element was imagewise exposed to white light in a commercial sensitometer to provide a developable latent image. The image was developed by uniformly heating the element for 10 seconds at 140° C. A light stable developed image was obtained. The developed image produced less than 0.01 increase in density units when exposed to 50,000 foot candle hours of white light illumination. The resulting developed image had a diffuse maximum transmission density of 1.6 and a minimum density of 0.2.

The maximum density of the image was 3.6 to blue light with a minimum density of 0.2.

The energy of exposure required to produce a developed density in the element of 0.1 above fog was about 200 ergs/cm$^2$. Efficiency measurements indicated that total development had occurred in both minimum density areas and maximum density areas. Developed silver particles had a particle size of 0.4 microns in the minimum density areas and a particle size of 0.05 microns in the maximum density areas respectively. Developed images provided satisfactory contrast when observed with ultraviolet radiation.

The activator precursor, that is the imidazolidone trichloroacetate compound, in the above formulation melts and decarboxylates at 112° C and liberates 1-(β-aminoethyl)-2-imidazolidone which has a satisfactorily low volatility at the desired processing temperature.

The procedure was repeated with the exception that 0.45 milligrams per square decimeter of 1-methyl-3-[2-(methylcarbamoylthio)ethyl]urea was added to the described formulation. The resulting element had improved preprocess stability. The photosensitive composition containing this urea compound was exposed to 38° C at 50% relative humidity conditions for one week. After this incubation period, the element was imagewise exposed and processed, as described above, to provide a loss in maximum density in the image of 0.1 and an increase in minimum density of 0.1.

EXAMPLE 2

Use of a Toning Agent

The procedure described in Example 1 was repeated with the exception that 0.15 milligrams per square decimeter of the toning agent, 3-imino-4-phenyl-1,2,4-triazolidine-5-thione, was added to the described formulation. Upon imagewise exposure and processing of the resulting element for 10 seconds at 140° C, a developed image was produced having a brown-black (neutral) image tone with a maximum density of 1.7 and a minimum density of 0.2.

The added toning agent also reduced the energy required to produce a density of 0.1 above fog to about 40 ergs/cm$^2$.

EXAMPLE 3

Use of a Silver Halide Photographic Emulsion Having Increased Grain Size

The procedure described in Example 1 was repeated with the exception that an unsensitized silver bromoiodide gelatino emulsion having a grain size of 0.15 microns was used in place of the described silver halide emulsion. The silver bromoiodide emulsion containing the 0.15 micron grain size was used at 12 mg Ag/dm$^2$.

A developed image was produced using this procedure. The developed image had a black tone with a maximum density of 1.8 and a minimum density of 0.2. The energy required to provide a density of 0.1 above fog was reduced to about 30 ergs/cm$^2$.

EXAMPLE 4

Heat Developable Element Containing Two Layers

A heat developable and heat stabilizable element was prepared like that described in Example 1 with 1-(β-aminoethyl)-2-imidazolidone trichloroacetate excluded. This element was then overcoated with 40 mg/dm$^2$ of 1-(β-aminoethyl)-2-imidazolidone trichloroacetate with 15 mg/dm$^2$ of ethyl cellulose. This composition was coated from a methanol solvent. After coating, the layer was permitted to dry to provide the desired element. The heat developable and heat stabilizable element was imagewise exposed as described in Example 1 to provide a developable latent image. The image was developed by heating the element for 10 seconds at 160° C. The developed image was stable to light and had a maximum density of 1.6 and a minimum density of 0.3.

EXAMPLE 5

Use of Covering Power Imaging Formulation at Lower Levels

A heat developable and heat stabilizable photographic element was prepared by mixing and coating at a 4 mil wet coating thickness on a poly(ethylene terephthalate) film support the following components:

| | | |
|---|---|---|
| photographic gelatin | 25 | mg/dm$^2$ |
| surfactant (Surfactant 10G) | 0.8 | mg/dm$^2$ |
| 1-(β-aminoethyl)-2-imidazolidone trichloroacetate | 26 | mg/dm$^2$ |
| 4-hydroxymethyl-4-methyl-1-phenyl-3-pyrazolidone | 5 | mg/dm$^2$ |
| 1-methyl-3-[2-(methylcarbamoylthio) ethyl]urea (development restrainer) | 0.4 | mg/dm$^2$ |
| silver bromoiodide gelatino emulsion (unsensitized, 0.1 micron particle | 5.5 | mg Ag/dm$^2$ |

-continued

| | | |
|---|---|---|
| size, 2.5 mole % iodide) | | |

The resulting element was imagewise exposed to light to provide a developable latent image in the element. The image was developed by heating the element for 10 seconds at 160° C. The resulting developed image was stable to light and had a maximum density of 1.2 and a minimum density of 0.2 to white light. The developed image had a maximum density of 2.8 and a minimum density of 0.3 to blue light.

The photographic material of this example was capable of providing an image having a resolution of 400 lines per millimeter. It accordingly was useful for microimaging purposes.

EXAMPLE 6

Use of another 3-Pyrazolidone Developing Agent

The following composition was mixed and then coated on a poly(ethylene terephthalate) film support as described in Example 1:

| | | |
|---|---|---|
| photographic gelatin | 25 | mg/dm$^2$ |
| surfactant (Surfactant 10G) | 1 | mg/dm$^2$ |
| 1-(β-aminoethyl)-2-imidazolidone trichloroacetate | 50 | mg/dm$^2$ |
| 4-methyl-1-phenyl-3-pyrazolidone | 10 | mg/dm$^2$ |
| sodium bromide | 0.2 | mg/dm$^2$ |
| silver bromoiodide gelatino emulsion (unsensitized, 0.1 micron particle size, 2.5 mole % iodide) | 10 | mg Ag/dm$^2$ |

The resulting element was imagewise exposed as described in Example 1 to provide a developable latent image. The image was developed by heating the element for 10 seconds at 160° C to provide a developed image having a maximum density of 1.4 and a minimum density of 0.3.

EXAMPLE 7

Overcoated Element

The following aqueous composition was mixed and then coated at a 4 mil wet coating thickness on a poly(ethylene terephthalate) film support:

| | | |
|---|---|---|
| photographic gelatin | 25 | mg/dm$^2$ |
| surfactant (Surfactant 10G) | 1 | mg/dm$^2$ |
| 1-(β-aminoethyl)-2-imidazolidone trichloroacetate | 50 | mg/dm$^2$ |
| 4-hydroxymethyl-4-methyl-1-phenyl 3-pyrazolidone | 10 | mg/dm$^2$ |
| sodium bromide | 0.2 | mg/dm$^2$ |
| 1-methyl-3-[2-(methylcarbamoylthio) ethyl]urea (development restrainer) | 5 | mg/dm$^2$ |
| silver bromoiodide gelatino emulsion (unsensitized, 0.1 micron particle size, 2.5 mole % iodide) | 10 | mg Ag/dm$^2$ |

The resulting heat developable photographic element was permitted to dry and then was overcoated with 5 mg/dm$^2$ of a copolymer of cyclohexane-1,4-dicarboxylic acid and 1,4-di(hydroxymethyl)cyclohexane.

The resulting element was permitted to dry and then was imagewise exposed as described in Example 1 to provide a developable latent image. The image was developed by heating the element for 10 seconds at 160° C. This provided a developed image which was stable to light having a maximum density of 1.7 and a minimum density of 0.2 to white light. The developed image had a maximum density of 2.9 and a minimum density of 0.2 to blue light. The resulting processed element was dry to the touch and after processing provided good post-processing clarity.

EXAMPLE 8

Use of Another Binder

An aqueous melt was prepared and coated at a wet coating thickness of 4 mils on a poly(ethylene terephthalate) film support. The aqueous melt had the following composition:

| | | |
|---|---|---|
| polymeric binder consisting of the copolymer of methyl methacrylate/3-methacryloyloxypropane-1-sulfonic acid, sodium salt/2-acetoacetoxyethyl methacrylate with weight ratio of monomers being 30:60:10% | 20 | mg/dm$^2$ |
| surfactant (Surfactant 10G) | 1 | mg/dm$^2$ |
| 1-($\beta$-aminoethyl)-2-imidazolidone trichloroacetate | 50 | mg/dm$^2$ |
| 4-hydroxymethyl-4-methyl-1-phenyl-3-pyrazolidone | 10 | mg/dm$^2$ |
| sodium bromide | 0.2 | mg/dm$^2$ |
| silver bromoiodide gelatino emulsion (unsensitized, 0.1 micron particle size, 2.5 mole % iodide, low gelatin level) | 10 | mg Ag/dm$^2$ |

The resulting heat developable photographic element was permitted to dry and then imagewise exposed to light to provide a developable latent image as described in Example 1. The resulting image was developed by heating the element for 10 seconds at 160° C. The developed image had a maximum density of 1.2 and a minimum density of 0.1.

EXAMPLE 9

Non-Aqueous Formulation for Covering Power Imaging

The following components were mixed and coated at a 4 mil wet coating thickness on a poly(ethylene terephthalate) film support using a solvent consisting of 4 parts by volume ethanol and one part by volume toluene:

| | | |
|---|---|---|
| poly(vinyl butyral) (polymeric binder) | 18 | mg/dm$^2$ |
| 4-hydroxymethyl-4-methyl-1-phenyl-3-pyrazolidone | 10 | mg/dm$^2$ |
| silver bromoiodide poly(vinyl butyral) peptized emulsion (unsensitized, 0.08 micron particle size, 2.5 mole % iodide) | 10 | mg Ag/dm$^2$ |

The resulting layer was permitted to dry and was then overcoated with the following composition:

| | | |
|---|---|---|
| ethyl cellulose | 20 | mg/dm$^2$ |
| 1-($\beta$-aminoethyl)-2-imidazolidone trichloroacetate | 60 | mg/dm$^2$ |
| 5-methylbenzotriazole (antifoggant) | 2 | mg/dm$^2$ |

The composition which was overcoated was coated from a methanol solvent.

The resulting overcoat layer was permitted to dry to provide the desired covering power imaging, heat developable and heat stabilizable photographic element. The element was imagewise exposed to light as described in Example 1 to provide a developable latent image in the element. The image was developed by heating the element for 10 seconds at 140° C. The resulting developed image was stable to light and had a maximum density of 1.2 and a minimum density of 0.1. The developed image had a maximum density of 1.6 and a minimum density of 0.2 to blue light.

The processed element upon storage provided good clarity.

EXAMPLE 10

Use of Activator Precursor Containing A bis(sulfonylacetic acid) moiety

The procedure described in Example 1 was repeated with the exception that the 1-($\beta$-aminoethyl)-2-imidazolidone salt of methylene bis(sulfonylacetic acid) was used as an activator precursor in place of the described activator precursor. The bis(sulfonylacetic acid) compound was used at 40 mg/dm$^2$ in the described element.

The resulting photographic element was imagewise exposed to light as described in Example 1 to provide a developable latent image. The image was developed by heating the element for 10 seconds at 150° C. The developed image was stable to light and had a maximum density of 1.6 and a minimum density of 0.2.

EXAMPLE 11

Use of Tyramine Trichloroacetate as Activator Precursor

The procedure described in Example 1 was repeated with the exception that tyramine trichloroacetate was used in place of the described activator precursor at 45 mg/dm$^2$.

The resulting photographic element was imagewise exposed to light to provide a developable latent as described in Example 1. The image was developed by heating the element for 10 seconds at 160° C. The resulting developed image had a maximum density of 1.6 and a minimum density of 0.2. The developed image had a maximum density of 3.6 and a minimum density of 0.3 to blue light.

The resulting developed image was exposed to 10,000 foot candle hours of white light exposure. The print-up density observed after this light exposure was 0.05. This illustrated that the image was very stable to light exposure following processing.

The procedure was repeated with the exception that the element prior to imagewise exposure was incubated for one week at 38° C and 50% relative humidity. The resulting element provided no significant loss in maximum image density upon imagewise exposure and processing. Minimum density increased by approximately 0.1. This illustrated that the heat developable and heat stabilizable element according to the invention was very stable prior to imagewise exposure and processing.

EXAMPLE 12

Use of 4-Aminopyridine Trichloroacetate as Activator Precursor

The procedure described in Example 1 was repeated with the exception that 4-aminopyridine trichloroacetate was used as an activator precursor in place of the described activator precursor. The 4-aminopyridine trichloroacetate was used at a concentration of 50 mg/dm$^2$ of support.

The resulting photographic element was imagewise exposed to light to provide a developable latent image as described in Example 1. The image was developed by heating the element for 10 seconds at 160° C. The resulting developed image had a purple tone with a maximum density of 2.1 and a minimum density of 0.2.

The resulting developed image was exposed to 50,000 foot candle hours of light exposure. The print-up density after this exposure period was about 0.1. This illustrated that the resulting developed image was very stable to light exposure.

EXAMPLE 13

Use of Equivalent Activator Precursor Composition

The following components were mixed and coated at a 4 mil wet coating thickness from an aqueous solution on poly(ethylene terephthalate) film support:

| | | |
|---|---|---|
| photographic gelatin | 25 | $mg/dm^2$ |
| surfactant (Surfactant 10G) | 1 | $mg/dm^2$ |
| sodium trichloroacetate | 40 | $mg/dm^2$ |
| malonamide | 20 | $mg/dm^2$ |
| 4-hydroxymethyl-4-methyl-1-phenyl-3-pyrazolidone | 10 | $mg/dm^2$ |
| sodium bromide | 0.2 | $mg/dm^2$ |
| silver bromoiodide gelatino emulsion (unsensitized, 0.1 micron particle size, 2.5 mole % iodide) | 10 | mg $Ag/dm^2$ |

The resulting coating was permitted to dry at 43° C and was then overcoated with 5 $mg/dm^2$ of poly(ethylmethacrylate) from dichloromethane solvent. The overcoat was permitted to dry.

The resulting photographic element was imagewise exposed to light to provide a developable latent image as described in Example 1. The image was developed by heating the element for 20 seconds by immersing the element in a fluorocarbon bath at 140° C. A developed image was produced having a maximum density of 1.7 and a minimum density of 0.3.

EXAMPLE 14

(Comparative Example)

The following composition was coated similarly to Example 1:

| | | |
|---|---|---|
| photographic gelatin | 30 | $mg/dm^2$ |
| surfactant (Surfactant 10G) | 1 | $mg/dm^2$ |
| guanidinium trichloroacetate | 66 | $mg/dm^2$ |
| 4-hydroxymethyl-4-methyl-1-phenyl-3-pyrazolidone | 15 | $mg/dm^2$ |
| silver bromoiodide gelatino emulsion (sulfur and gold chemically sensitized, 0.15 micron particle size, 2.5 mole % iodide) | 12 | $mg/dm^2$ |

Following sensitometric exposure of the resulting element and processing for 10 seconds at 150° C, a $D_{max}$ of 2.2 and a $D_{min}$ of 1.7 was obtained. No covering power imaging was observed.

The invention has been described in detail with particular reference to preferred embodiments thereof, but it will be understood that variations and modifications can be effected within the spirit and scope of the invention.

What is claimed is:

1. A covering power imaging, heat developable and heat stabilizable photographic element comprising a support having thereon in reactive association (a) photographic silver salt, (b) a photographic silver salt developing agent, (c) an activating concentration of a development activator precursor represented by the formula:

$A^{\oplus} \cdot B^{\ominus}$ wherein $A^{\oplus}$ is a protonated primary, secondary or tertiary amine having a pKa within the range of about 8 to 12; and $B^{\ominus}$ is a carboxylate ion, wherein said activator precursor releases a non-volatile amine moiety at a temperature within the range of 120° to 200° C, (d) a polymeric binder, and wherein said element (1) contains no separate post-processing image stabilizer, and (2) provides silver image development efficiency of at least 90% when heated to a temperature within the range of 120° to 200° C.

2. A covering power imaging, heat developable and heat stabilizable photographic element as in claim 1 wherein said photographic silver salt is photographic silver halide.

3. A covering power imaging, heat developable and heat stabilizable photographic element as in claim 1 wherein said photographic silver salt developing agent is a 3-pyrazolidone silver halide developing agent.

4. A covering power imaging, heat developable and heat stabilizable photographic element as in claim 1 wherein $A^{\oplus}$ is represented by the formula:

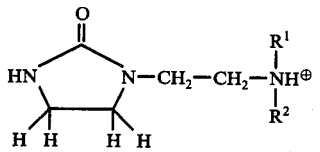

wherein $R^1$ and $R^2$ are independently selected from the group consisting of hydrogen and alkyl containing 1 to 10 carbon atoms.

5. A covering power imaging, heat developable and heat stabilizable photographic element as in claim 1 wherein $B^{\ominus}$ is alpha-sulfonylacetic acid.

6. A covering power imaging, heat developable and heat stabilizable photographic element as in claim 1 wherein $B^{\ominus}$ is represented by the formula:

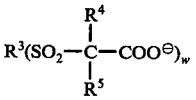

wherein $w$ is 1 or 2; $R^3$ is alkyl containing 1 to 10 carbon atoms, aryl containing 6 to 10 carbon atoms and pyridyl; or carboxymethyl when $w$ is 1 and alkylene containing 1 to 6 carbon atoms, arylene containing 6 to 8 carbon atoms when $w$ is 2; $R^4$ and $R^5$ can be the same or different and individually represent hydrogen, alkyl containing 1 to 6 carbon atoms, aryl containing 5 to 10 carbon atoms or pyridyl.

7. A covering power imaging, heat developable and heat stabilizable photographic element as in claim 1 wherein said activating concentration is within the range of 0.4 to 3.0 moles of said development activator precursor per mole of silver in said element.

8. A covering power imaging, heat developable and heat stabilizable photographic element as in claim 1 also comprising a thionamide image toner.

9. A covering power imaging, heat developable and heat stabilizable photographic element comprising a support having thereon in reactive association (a) photographic silver halide gelatino emulsion, (b) a photographic silver halide developing agent, (c) an activating concentration of a development activator precursor consisting essentially of 1-(beta-aminoethyl)-2-imidazolidone trichloroacetate, (d) a polymeric binder, and wherein said element (1) contains no separate post-processing image stabilizer precursor, and (2) provides silver image development efficiency of at least 90% when heated to a temperature within the range of 120° to 200° C.

10. A covering power imaging, heat developable and heat stabilizable photographic element as in claim 9 also comprising 1-methyl-3-[2-(methylcarbamoylthio)ethyl]urea as a development restrainer and 3-imino-4-phenyl-1,2,4-triazolidine-5-thione as an image toner.

11. A covering power imaging, heat developable and heat stabilizable photographic composition comprising (a) photographic silver salt, (b) a photographic silver salt developing agent, (c) an activating concentration of a development activator precursor represented by the formula:

$$A^{\oplus} \cdot B^{\ominus}$$

wherein $A^{\oplus}$ is a protonated primary, secondary or tertiary amine having a pKa within the range of about 8 to 12; and $B^{\ominus}$ is a carboxylate ion, wherein said activator precursor releases a non-volatile amine moiety at a temperature within the range of 120° to 200° C, (d) a polymeric binder, and wherein said composition (1) contains no separate post-processing image stabilizer, and (2) provides silver image development efficiency of at least 90% when heated to a temperature within the range of 120° to 200° C.

12. A covering power imaging, heat developable and heat stabilizable photographic composition as in claim 11 wherein said photographic silver salt is photographic silver halide.

13. A covering power imaging, heat developable and heat stabilizable photographic element as in claim 11 wherein said photographic silver salt developing agent is a 3-pyrazolidone silver halide developing agent.

14. A covering power imaging, heat developable and heat stabilizable photographic composition as in claim 11 wherein $A^{\oplus}$ is represented by the formula:

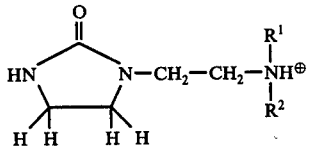

wherein $R^1$ and $R^2$ are independently selected from the group consisting of hydrogen and alkyl containing 1 to 10 carbon atoms.

15. A covering power imaging, heat developable and heat stabilizable photographic composition as in claim 11 wherein $B^{\ominus}$ is an alpha-sulfonylacetic acid.

16. A covering power imaging, heat developable and heat stabilizable photographic composition as in claim 11 wherein $B^{\ominus}$ is represented by the formula:

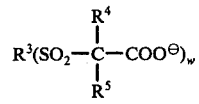

wherein $w$ is 1 or 2; $R^3$ is alkyl containing 1 to 10 carbon atoms, aryl containing 6 to 10 carbon atoms and pyridyl; or carboxymethyl when $w$ is 1 and alkylene containing 1 to 6 carbon atoms, arylene containing 6 to 8 carbon atoms when $w$ is 2; $R^4$ and $R^5$ can be the same or different and individually represent hydrogen, alkyl containing 1 to 6 carbon atoms, aryl containing 5 to 10 carbon atoms or pyridyl.

17. A covering power imaging, heat developable and heat stabilizable photographic composition as in claim 11 wherein said activating concentration is within the range of 0.4 to 3.0 moles of said development activator precursor per mole of silver in said composition.

18. A covering power imaging, heat developable and heat stabilizable photographic composition as in claim 11 also comprising a thionamide image toner.

19. A covering power imaging, heat developable and heat stabilizable photographic composition comprising (a) photographic silver halide gelatino emulsion, (b) a photographic silver halide developing agent, (c) an activating concentration of a development activator precursor consisting essentially of 1-(beta-aminoethyl)-2-imidazolidone trichloroacetate, (d) a polymeric binder, and wherein said composition (1) contains no separate post-processing image stabilizer precursor, and (2) provides a silver image development efficiency of at least 90% upon heating the element to a temperature within the range of 120° to 200° C.

20. A covering power imaging, heat developable and heat stabilizable photographic composition as in claim 19 also comprising 1-methyl-3-[2-methylcarbamoylthio)ethyl]urea as a development restrainer and 3-imino-4-phenyl-1,2,4-triazolidine as an image toner.

21. A process of developing and stabilizing an image in a covering power imaging, heat developable and heat stabilizable photographic element as defined in claim 1 comprising heating said element to a temperature within the range of 120° to 200° C. until said image is developed.

22. A process as in claim 21 comprising heating said element to a temperature within the range of 120° to 200° C for 2 to 60 seconds.

23. A process of developing and stabilizing an image in a covering power imaging, heat developable and heat stabilizable photographic element as defined in claim 9 comprising heating said element to a temperature within the range of 140° to 160° C for 4 to 60 seconds.

24. A covering power imaging, heat developable and heat stabilizable photographic element comprising a support having thereon a layer comprising (a) photographic silver halide, (b) a 3-pyrazolidone silver halide developing agent, (c) an activating concentration within the range of 0.4 to 3.0 moles per mole of silver of a development activator precursor having a pKa within the range of about 8 to 12 and represented by the formula: $A^{\oplus} \cdot B^{\oplus}$ wherein $A^{\oplus}$ is

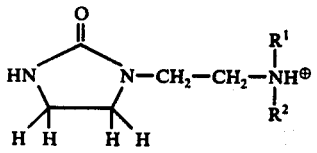

wherein $R^1$ and $R^2$ are independently selected from the group consisting of hydrogen and alkyl containing 1 to 10 carbon atoms; and $B^{\ominus}$ is alpha-sulfonylacetic acid, and wherein said activator precursor releases a non-volatile amine moiety at a temperature within the range of 120° to 200° C, (d) a polymeric binder, and wherein said element (1) contains no separate post-processing image stabilizer, and (2) provides silver image development efficiency of at least 90% when heated to a temperature within the range of 120° to 200° C.

* * * * *